United States Patent [19]

Shen et al.

[11] 3,976,557

[45] Aug. 24, 1976

[54] PRETREATMENT OF COAL-DERIVED LIQUID TO IMPROVE MAGNETIC SEPARATION OF SOLIDS

[75] Inventors: John Shen, Yardley, Pa.; Michael C. Chervenak, Pennington, N.J.

[73] Assignee: Hydrocarbon Research, Inc., Morristown, N.J.

[22] Filed: Nov. 29, 1974

[21] Appl. No.: 527,943

[52] U.S. Cl. ..... 208/10; 208/251 H; 210/222

[51] Int. Cl.[2] ..... C10G 1/06; C10G 34/00

[58] Field of Search ..... 208/8, 10, 293, 251 H; 210/222; 209/172.5, 214

[56] References Cited

UNITED STATES PATENTS

| | | | |
|---|---|---|---|
| 1,512,870 | 10/1924 | Ullrich et al. | 209/214 |
| 2,607,492 | 8/1952 | Anders | 208/251 R |
| 2,998,882 | 9/1961 | Leeman | 209/172.5 |
| 3,463,310 | 8/1969 | Ergun et al. | 209/8 |
| 3,725,241 | 4/1973 | Chervenak | 208/10 |

*Primary Examiner*—Delbert E. Gantz
*Assistant Examiner*—James W. Hellwege

[57] ABSTRACT

The removal of particulate solids containing iron sulfides from hydrogenated coal liquids by magnetic separation is improved by pretreatment of the liquid with a gas mixture containing hydrogen and hydrogen sulfide. The coal-derived liquid is contacted with the gas mixture containing at least about 2 vol. % hydrogen sulfide, with the remainder of the gas mixture comprising principally hydrogen. Residue time for the liquid-gas contact should be at least about two minutes and temperature should be less than about 650°F. The treated liquid is then passed through a magnetic field having strength of at least about 3000 gauss to achieve substantial removal of sulfur-containing solids from the liquid. The magnetic solids are then removed from the separator unit, e.g., by flushing using a light solvent oil, and the remaining liquid fraction carrying less-magnetic solids is passed on to further processing.

28 Claims, 5 Drawing Figures

Effects Of $H_2S$ Composition On Magnetic Susceptibility Improvement (Flash Pot Bottom)

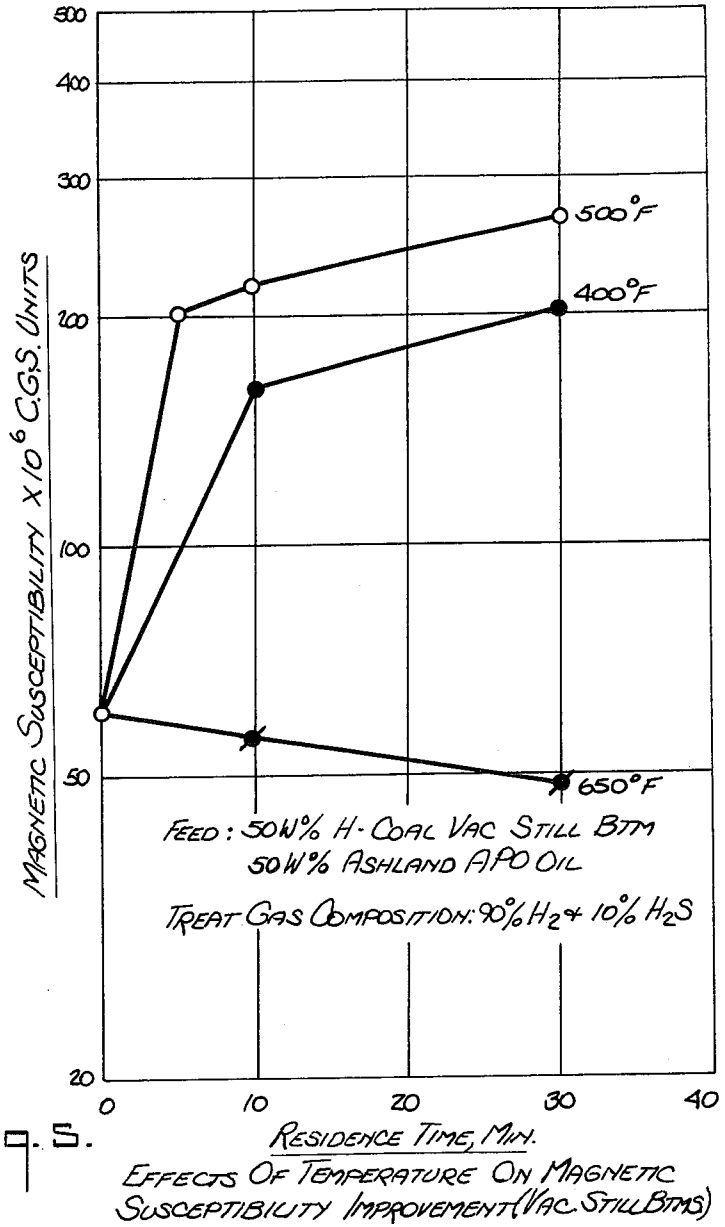
Fig. 5.
EFFECTS OF TEMPERATURE ON MAGNETIC SUSCEPTIBILITY IMPROVEMENT (VAC. STILL BTMS)
Fig. 4.
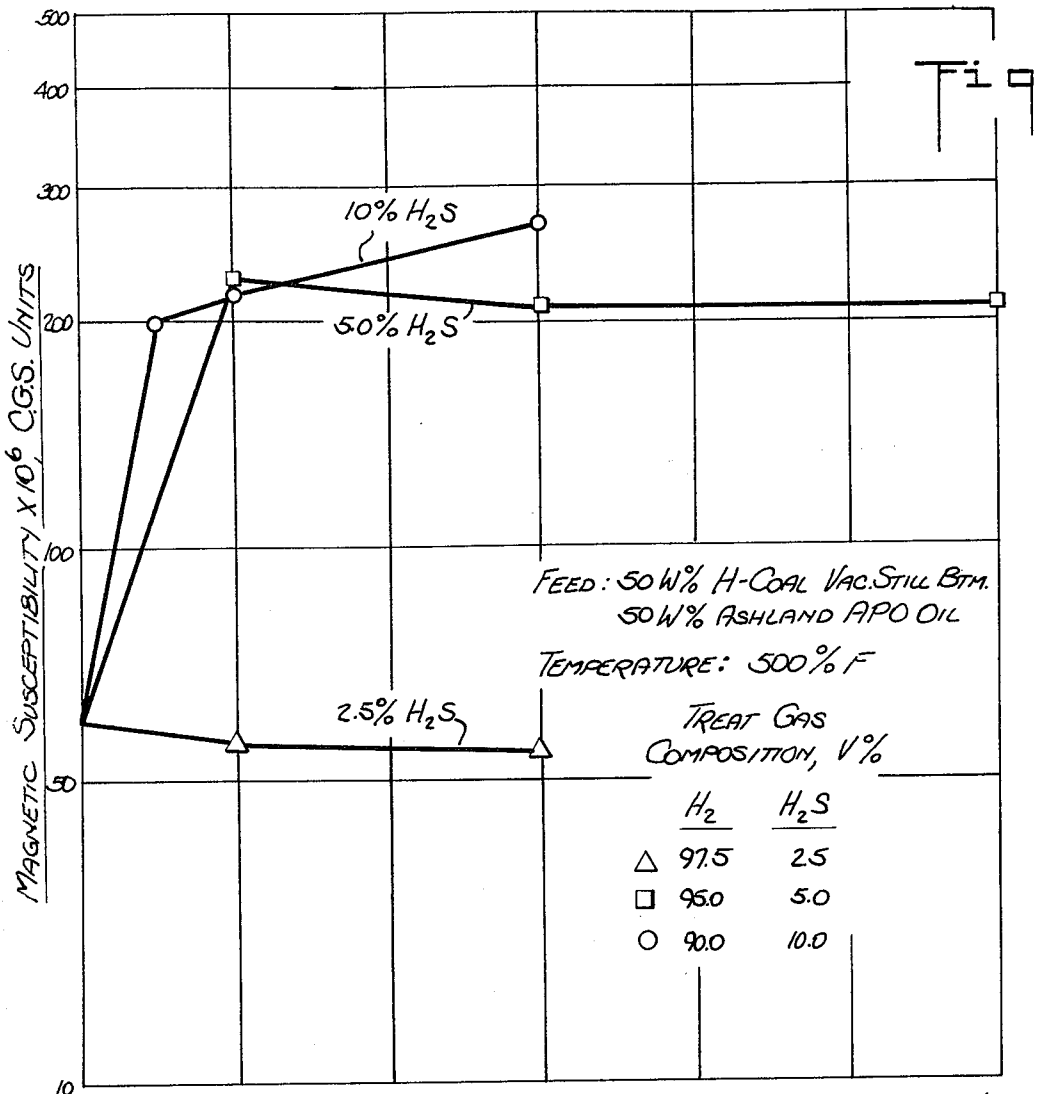
EFFECTS OF $H_2S$ COMPOSITION ON MAGNETIC SUSCEPTIBILITY IMPROVEMENT (VAC STILL BTMS.)

PRETREATMENT OF COAL-DERIVED LIQUID TO IMPROVE MAGNETIC SEPARATION OF SOLIDS

BACKGROUND OF THE INVENTION

It is known that pyrite ($FeS_2$) as usually found in coal has a relatively low magnetic susceptibility. However, when coal containing pyrite is hydrogenated in a reactor under elevated temperature and pressure conditions, it changes form and the magnetic susceptibility of the resulting iron sulfides initially increases over that of the form originally present in the coal. Upon further hydrogenation the iron sulfides continue to change form and their magnetic susceptibility reaches a peak value and then declines.

As described in U.S. Pat. No. 3,519,555 to Keith et al, the hydrogenation of coal to more valuable products (both liquids and gas) with achievement of better than 80 percent conversion of the coal, producing in the order of four barrels of oil per ton of coal, makes available an abundant alternative fuel source for commercially competitive fuels. It is recognized, however, that such liquid (coal-derived oil) usually contains considerable sulfur associated with unconverted coal solids and ash which together frequently amount to 15 to 20 wt. % of the coal. The sulfur-containing solids material portion must be substantially removed from the oil if it is to have commercial value and meet anti-pollution requirements.

The removal of metallic contaminants from coal and ores by magnetic separation means is well known. For example, it is well known in the water washing of coal to utilize magnetic separation for removing metal such as tramp iron. In the Leeman U.S. Pat. U.S. No. 2,998,882, it is suggested that magnetic separations of both coarse and fine particles can be accomplished to remove magnetite. In U.S. Pat. No. 3,463,310 to Ergun, it is suggested that electromagnetic heating of the iron particles in coal tends to convert them to a magnetic form. Ergun proposes to use microwave energy to convert pyrites to pyrrhotite, magnetite, etc. before magnetic separation.

The removal of ash solids from hydrogenated coal liquids by magnetic separation means is taught by U.S. Pat. No. 3,725,241 to Chervenak. However, it is desirable to enhance the magnetic susceptibility of sulfur-containing solids so that their removal can be achieved more easily and effectively at lower magnetic field strengths, thus producing low-sulfur liquid and char products.

SUMMARY OF THE INVENTION

It has now been discovered that hydrocarbon liquids derived from coal, and containing solids comprising iron sulfides and unconverted coal, when treated by a gas mixture containing hydrogen sulfide and hydrogen in particular proportions will have the magnetic susceptibility of such particles significantly increased. Such treated particles can then be more easily removed from the liquid by magnetic separation means and lower field strength and higher flow rate can be used than would otherwise be required.

Accordingly, this invention pertains to the removal of sulfur-containing solids from hydrocarbon liquid derived from coal by magnetic separation means, and particularly pertains to the pretreatment of such coal-derived liquids with a gas mixture comprising principally $H_2$ and $H_2S$ in order to improve the magnetic susceptibility of the iron sulfides present in the solids contained therein. Specifically, hydrogenated liquid derived from coal containing at least about 0.2 wt. % pyritic sulfur is contacted with a gas mixture containing hydrogen and hydrogen sulfide in particular proportions so that the liquid has at least about two minutes contact or residence time with the gas. This treated liquid is then passed through a magnetic separator having a magnetic field strength of at least about 3000 gauss, and the more magnetically susceptible solids are temporarily retained in the separator until periodically removed therefrom by suitable means. The remaining liquid containing reduced amounts of iron sulfides solids is withdrawn from the separator and passed on to further processing steps as desired.

It has also been observed that the magnetic susceptibility of the iron sulfides is dependent upon the processing steps employed as well as upon the $H_2S$ content in the treating gas. To remove such particulate solids containing iron sulfides, the coal-derived liquid is subjected to a pretreatment step comprising contacting the liquid with a gas mixture containing at least about 2 vol. % $H_2S$ gas with the remainder being principally hydrogen, as for example a gas mixture comprising about 5% hydrogen sulfide and about 95% hydrogen. Contact or residence time is at least about 2 minutes and preferably is about 5 to 15 minutes. The average gas-liquid contact temperature should be less than about 650°F and preferably is between about 350°–600°F. Although the effectiveness of this pretreatment of coal liquids with gas mixtures containing hydrogen sulfide and hydrogen is believed to be generally independent of pressure level, it is preferred that the gas-liquid contact pressure be sufficient to limit undesirable evaporation of the coal-derived liquid being treated. Accordingly, such contact pressure should be at least about 50 psig. and preferably between 100 and 350 psig.

The treated coal liquid is then passed to a magnetic separation step wherein the magnetic field strength is at least about 3000 gauss. The liquid portion containing less-magnetic or only slightly magnetic coal solids material passes through the separator unit. The unit can comprise a wet magnetic drum type separator, wherein the feedstream is passed in contact with an external magnetizable portion of the rotary drum. The magnetic solids in the feedstream are substantially retained on the drum outer surface until removed such as in an adjacent demagnetization zone or mechanically, while the liquid containing the less magnetic solids material passes on through the separation unit.

When increased magnetic field strengths are desireed, the magnetic separation unit can comprise a type having fluid flow passages containing a magnetizable metal matrix material. The treated liquid passes through the separator unit, while the more magnetic solids material is substantially retained on closely-spaced magnetizable metal matrix surfaces within the flow passages therein. Later, the retained magnetic solids are removed from the separator flow passages, either continuously or intermittently, depending upon the separator configuration. Such removal is preferably accomplished by a flushing action, usually using a flushing fluid such as a light solvent oil stream which is substantially free of solids and is preferably obtained from the coal hydrogenation process. The solids portion is then removed from the solvent liquid stream in a recovery step, such as a distillation tower, from which the solids-containing iron sulfides are removed for discard and the solvent is returned to the magnetic separator for reuse as the flushing liquid. If desired, steam can be used as an alternative passage flushing fluid for the magnetic separator passages.

The magnetic separator is preferably a unit adapted for continuous flow use, wherein the magnetizable metal matrix surfaces are moved into and out of the magnetic field cyclically. During the period when the magnetizable matrix surfaces are within the magnetic field, the sulfur-containing solids are substantially retained on the matrix surfaces within the fluid flow passages. Then, when the matrix moves out of the magnetic field and the matrix surfaces become demagnetized, a flushing fluid stream is flowed through the spaced matrix passages to flush out the trapped sulfur-containing solids material from the flow passages. The resulting mixture of solvent and magnetic sulfur-containing material is then preferably passed to a solvent recovery tower, from which the solvent liquid is returned to the magnetic separator for reuse and the sulfur-containing solids are removed for discard.

There is, of course, a general relationship which exists between the magnetic susceptibility of the coal-derived sulfur-containing particulate solids, the temperature and viscosity of the hydrocarbon liquid, and the magnetic field strength required for effective separation of the sulfur-containing solids therefrom. For particles which are slightly magnetic relatively high magnetic field strengths are required to effect a useful separation, particularly if the flowing liquid is moderately to highly viscous. Increased temperature of the liquid and/or use of normally less viscous liquids will permit somewhat lower field strengths to be effectively utilized for particle separation. To achieve useful separations, the magnetic field strength for this invention should be at least about 3000 gauss and preferably between about 5,000 to 20,000 gauss. Also for useful results, the viscosity of the solids-containing liquid as fed to the magnetic separator device should not exceed about 50 centipoise and preferably should not exceed about 10 centipoise.

Viscosity of the liquid passed through the magnetic separator may be adjusted by varying either the liquid composition of the liquid-solids stream, or by varying its temperature, or both. Usual operating conditions for the liquid-solids stream from which the solids are magnetically separated are temperatures from about 300° to about 600°F and liquid viscosities of 2–10 centipoise. The particle size of the sulfur-containing solids in this liquid-solids stream will usually be smaller than about 325 mesh (U.S. Std. Sieve Series), or smaller than about 40 microns.

While this invention appears to be applicable to various types of coal conversion processes wherein conversion of the feed to lower boiling liquids and gases is accomplished, for example solvent refining of coal, its use is preferred with coal-derived liquids produced from the upflow ebullated bed continuous catalytic hydrogenation process, wherein in excess of 80 vol. % conversions are obtained. This invention is particularly useful for coal feeds contaning at least about 0.5 wt. % total sulfur, and more particularly for coals containing at least about 0.2 wt. % pyritic sulfur.

The liquid stream from the magnetic separation step containing less-magnetic unreacted coal solids or char can be further processed as desired, which usually includes a partial removal or concentration of the less-magnetic solids by passing the liquid through a liquid-solids separation step, e.g., a hydroclone separator device. At least a portion of the resulting reduced solids liquid stream can be recycled to the coal reaction zone to help control the solids concentration therein within desirable limits, and the remaining liquid stream containing increased concentration of coal solids is passed to further processing as desired.

DESCRIPTION OF THE DRAWINGS

FIG. 3 is a graph showing magnetic susceptibility vs. contact time for a flash pot bottoms oil stream.

FIGS. 4 and 5 are graphs showing magnetic susceptibilities vs. contact times for diluted vacuum still bottoms oil stream.

BROAD DESCRIPTION OF INVENTION

Figure 1:
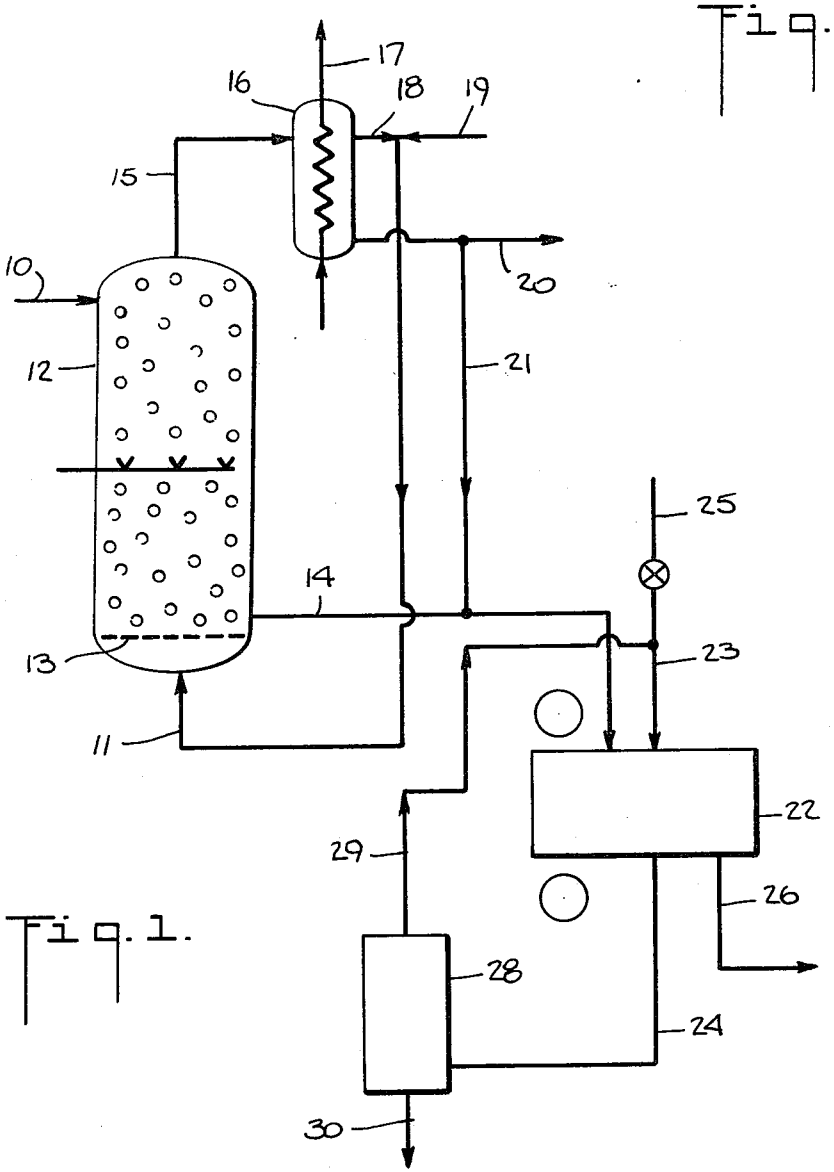
FIG. 1 is a schematic view showing the essential process steps of the invention.
Figure 2:
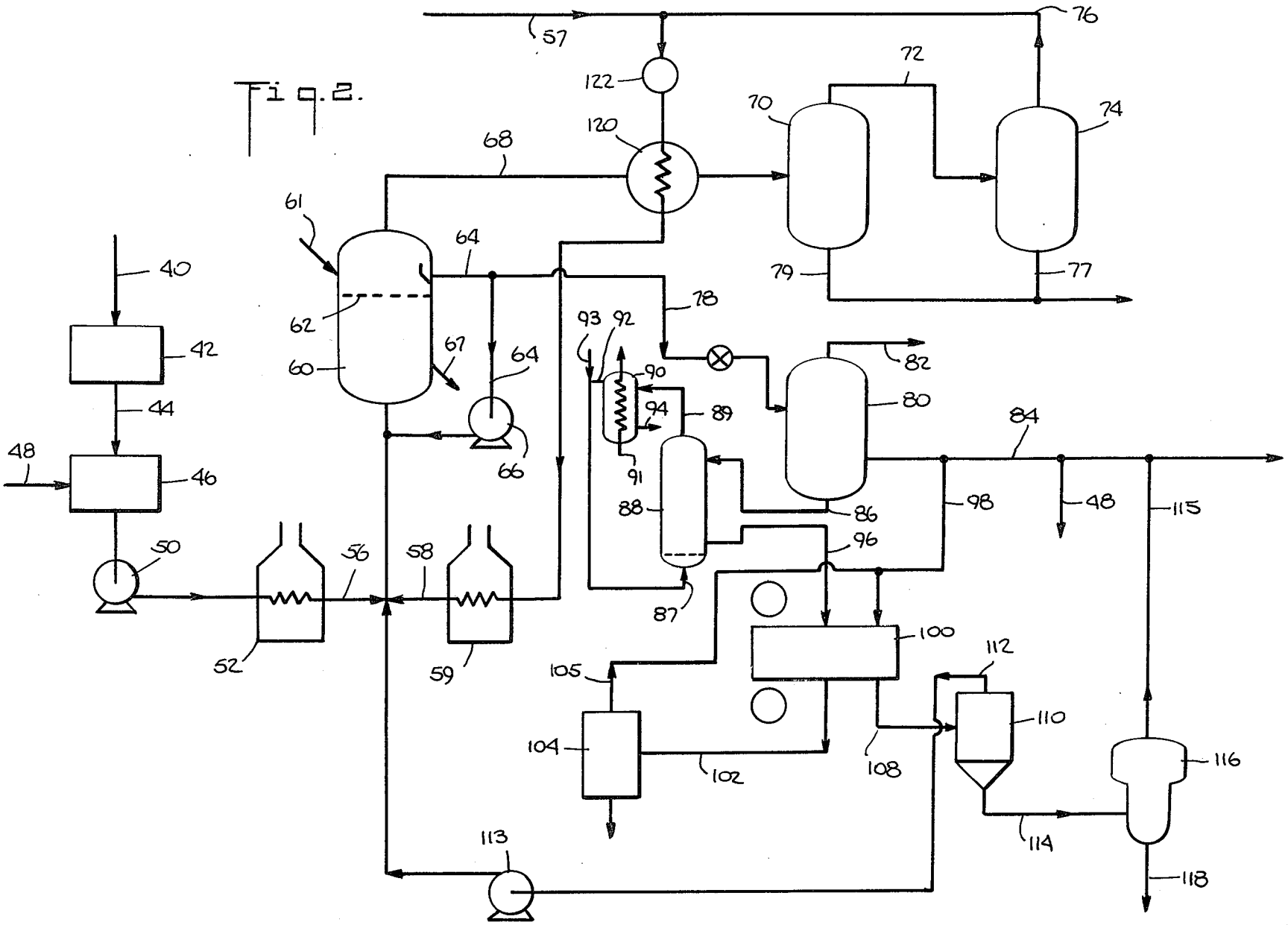

This invention will now be described in its broadest scope as illustrated by FIG. 1. A coal-derived liquid containing particulate solids comprising iron sulfides and unconverted coal at 10 is first passed to a gas-liquid contacting step 12, wherein the liquid is intimately contacted with a gas mixture 11 containing hydrogen and hydrogen sulfide. Preferably, the gas mixture 11 contains about five to about 15 volume percent hydrogen sulfide with the remainder being substantially hydrogen, and is introduced into contactor 12 through a distributor 13. The dimensions of gas-liquid contactor 12 should be so selected in relation to the flow rates as to provide a gas-liquid contact time of at least about 2 minutes, and preferably between about 5 and 15 minutes for best results. The gas-treated liquid is withdrawn at 14, while the resulting gas mixture containing some entrained hydrocarbon liquid is withdrawn from the contactor at 15 and is preferably passed to a condenser 16. In condenser 16 gas stream 15 is cooled against a suitable fluid at 17 such as water, and the resulting vapor is withdrawn at 18 for return to the lower end of the gas-liquid contactor 12, along with some make-up gas mixture at 19 as needed. The condensed liquid is withdrawn from condenser 16 as a product stream 20, or alternatively is returned as stream 21 to treated coal liquid stream 14.

The treated coal liquid 14 is next passed to a magnetic separation unit 22, having a field strength of at least about 3000 gauss and preferably about 5000 to 20,000 gauss. By applying the desired magnetic force to liquid-solids stream 14, iron sulfide particles having increased magnetic susceptibility are initially retained in the separator flow passages. These solids are then periodically removed from the flow passages, preferably by flushing action using a flushing fluid 23 such as a solvent oil to form discharge stream 24. The remaining oil portion containing less-magnetic particulate solids passes through separator 22 as stream 26.

Solids-containing stream 24 is passed to a suitable solvent recovery means 28 such as a distillation tower for recovery of the solvent oil. From tower 28, the solvent oil recovered is returned as stream 29 to magnetic separator 22 as flushing stream 23, along with make-up solvent from stream 25 as required. The sulfur containing solids are removed at 30 for further processing or discard.

DESCRIPTION OF THE PREFERRED EMBODIMENT

Figure 2:
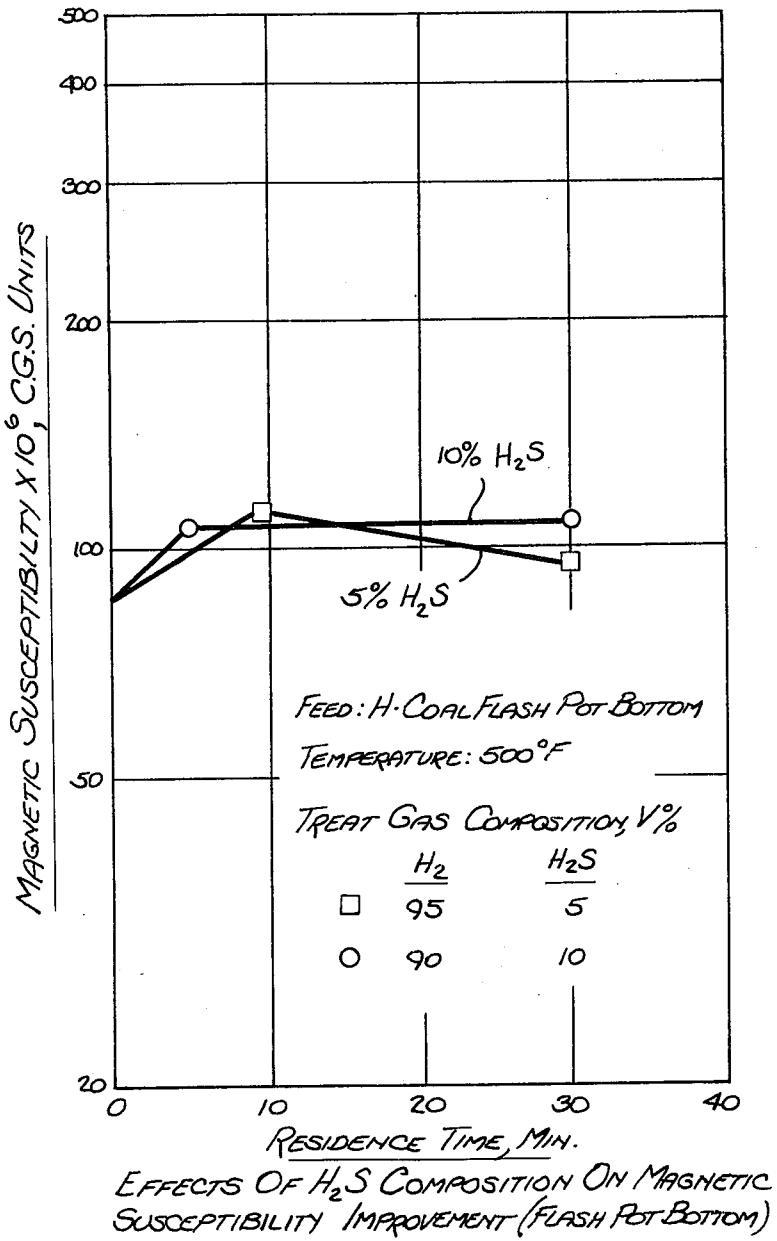
FIG. 2 is another schematic view showing the invention utilized in a coal liquefaction process.

This invention will now be described as preferably employed in an upflow ebullated bed type hydrogenation process for coal. As shown in FIG. 2, a coal such as bituminous or semi-bituminous type having total sulfur above about 3 wt. % and at least 0.2 wt. % in pyritic form enters the system at 40 and is first passed through a preparation unit generally indicated at 42. In such unit the coal is dried of substantially all surface moisture and ground to a desired mesh size and screened for uniformity. For our purposes, it is preferable that the coal has a particle size of about 50 to 375 mesh (U.S. Sieve Series).

The coal fines are discharged into transfer line 44 and pass to slurry tank 46 where the coal is blended with a carrying oil indicated at 48, which is conveniently obtained from within the system. To establish an effectively transportable slurry, it is found that the ground coal should be mixed with at least about an equal weight of slurrying oil.

The resulting coal-oil slurry is pressurized by pump 50 to superatmospheric pressure such as 500–5000 psi, and is then passed through heater 52 to bring the slurry to a temperature in the order of 600°F to 850°F. Such heated coal-oil slurry is then discharged into the reactor feed line 56 wherein it is supplied with heated hydrogen from line 58.

The entire mixture of coal-oil slurry and hydrogen then enters reactor 60, passing upwardly from the bottom at a rate and under a pressure and at a temperature effective to accomplish the desired hydrogenation. In addition, particulate hydrogenation catalyst may be added to reactor 60 at connection 61 in the ratio of about 0.1 to 2.0 pounds of catalyst per ton of coal. Such a catalyst would be from the class of cobalt, iron, molybdenum, nickel, tin and the like deposited on a base of the class of alumina, magnesia, silica, and the like and be of a size of at least 1/32 inch and more frequently as extrudates in the range of 1/16 to ¼ inch, i.e., between about 3 and 14 mesh of the U.S. Sieve Series scale.

By concurrently flowing streams of liquid and gasiform materials upwardly through a vessel containing a mass of solid particles of a contact material, which may be a specific catalyst as above indicated, and expanding the mass of solid particles at least 10 percent over the volume of the stationary mass, the solid particles are placed in random motion within the vessel by the upflowing streams. A mass of solid particles in this state of random motion in a liquid medium may be described as "ebullated." The characteristics of the ebullated mass at a prescribed degree of volume expansion can be such that a finer, lighter particulate solid will pass upwardly through the catalyst mass, so that the contact particles constituting the ebullated mass are retained in the reactor and the finer, lighter material may pass from the reactor. The catalyst bed upper level 62 above which few, if any, particles ascend is called the upper level of ebullation.

In general, the gross density of the stationary mass of contact material will be between about 25 and 200 pounds per cubic foot, the flow rate of the liquid will be between about 5 and 120 gallons per minute per square foot of horizontal cross section area of the ebullated mass, and the expanded volume of the ebullated mass usually will be not more than about double the volume of the settled mass. A recycle liquid stream 64, which may be located either internal or external of the reactor, may be removed from above the upper level of ebullation 62, and recycled by pump 66 to the bottom of the reactor 60 to maintain the desired superficial upward liquid velocity in the reactor. Spent catalyst may be removed by drawoff at connection 67 to maintain the desired catalytic activity within the reaction zone.

Reactor operating conditions are in the range of 700° to 950°F temperature and 1000–4000 psi partial pressure of hydrogen, preferably 750°–900°F and 1500–3000 psi partial pressure. Coal throughput or space velocity is at the rate of 15 to 150 pounds coal per hour per cubic foot of reactor space, so that the yield of unreacted coal as char is between 5 and 15 wt. % of the quantity of moisture and ash-free feed. The relative size of the coal and catalyst particles and conditions of ebullation are such that the catalyst is retained in the reactor, while the ash and unreacted char particles are carried out with the liquid reaction products.

From reaction zone 60 a gasiform effluent stream 68 which is virtually free of solid particles of contact material is separately withdrawn, cooled and then passed to phase separator 70. From separator 70, a gas stream is removed at 72 and passed to absorber 74. A medium-purity hydrogen stream 76 recovered from absorber 74 is recycled along with make-up hydrogen stream 57 through heater 59 to the reactor 60 to provide the hydrogen requirements there as heated hydrogen stream 58. A liquid stream 77 recovered from the absorber 74 may be joined with liquid stream 79 removed from the separator 70, and the combined liquid stream is withdrawn at reduced pressure as liquid product, such as distillate or fuel oil.

A solids-containing liquid effluent stream 78 is separately withdrawn from the reaction zone 60, reduced to lower pressure and passed to phase separator system 80. This separator system operates at 500°–650°F temperature and permits removal of a high Btu heating value gaseous product stream at 82 and a substantially solids-free liquid stream at 84. A portion of the liquid from line 84 may be used as stream 48 to prepare the initial coal-oil slurry in tank 46. A separator bottoms liquid stream (flash pot bottoms) containing unconverted coal solids or char and ash is removed at 86.

The oil-solids mixture in line 86, which usually has a solids concentration in the range of 5 to 15 wt. %, temperature of 400°–600°F, and viscosity of 2 to 10 centipoise, is passed to gas-liquid contactor 88, wherein the liquid is contacted with a gas mixture 87 containing hydrogen and hydrogen sulfide for treating the coal-derived liquid. This treating gas preferably contains about 5–15 vol. % hydrogen sulfide with the remainder being mainly hydrogen, and is usually bubbled through the liquid in contactor 88, at pressure between about 50 and 350 psig. The resulting gas mixture containing some entrained hydrocarbon liquid is withdrawn at 89 and passed to condenser 90, wherein the gas stream 89 is cooled against a convenient fluid 91 such as water. The resulting vapor is withdrawn at 92 for return to the lower end of gas-liquid contactor 88, along with some make-up gas mixture at 93 as needed. The condensed liquid is withdrawn at 94 and may be combined with some other product liquid stream, or alternatively can be returned to gas-treated liquid stream 96.

The treated coal liquid is next passed to magnetic separation unit 100 for removal of the iron sulfide particles having increased magnetic susceptibility and which are retained on the metal matrix surfaces within the magnetized flow passages. This unit has a field strength of at least about 3000 gauss and preferably between about 5000 and 20,000 gauss. It preferably may be a rotary or drum type separator unit having appropriate rotatable and magnetizable metal matrix surfaces suitably controlled by magnetic circuits to energize portions thereof during drum rotation. By applying the desired magnetic force to liquid-solids stream 96 passing through the separator, the magnetically susceptible solids are initially retained in the separator until they are periodically flushed out by solvent oil stream 98 to form discharge stream 102. This solids-containing stream 102 is passed to a suitable solvent recovery means such as distillation tower 104 for recovery of the oil solvent. From tower 104, the solvent oil recovered is returned as stream 95 to the magnetic separator 100 via stream 98, and the sulfur-containing solids are removed as stream 106 for further processing or discard.

The oil portion containing less-magnetic solids passes through magnetic separator 100 as stream 108 and is passed to liquid-solids separator 110, which is preferably a liquid hydroclone unit. Overflow stream 112 containing reduced percentage solids is returned via pump 113 to reactor 60 to assist in the control of the solids therein to the desired concentration. Underflow stream 114 containing increased concentration of solids (reduced sulfur-containing char particles) is withdrawn and passed to vacuum still 116 for further removal of the liquid portion from the stream. Resulting liquid stream 115 is combined with product liquid stream 84, while vacuum bottoms stream 118 containing about 25–45 wt. % solids is withdrawn and may be used for coking or as a feed stream for production of the hydrogen needed in the system.

To assist in the separation and recovery of gaseous and liquid products in separation unit 70, the gasiform effluent stream withdrawn from the top of reaction zone 60 is cooled, preferably against the recycled hydrogen stream. Such cooling of the reacor effluent stream also desirably reduces the heating requirements for the recycle hydrogen stream as provided at heater 59. Specifically, gaseous effluent stream 68 withdrawn from reaction zone 60 is preferably cooled against recycle hydrogen stream 58 in heat exchanger 120. Compressor 122 serves to restore sufficient pressure to the recycle hydrogen stream 58 to permit it to be reintroduced into the bottom of reactor 60.

While in FIG. 2 a separator bottoms liquid stream 86 is shown and described as being treated with a gas mixture of hydrogen and hydrogen sulfide to improve its magnetic susceptibility before passing the solids-containing liquid stream to magnetic separator 100, the invention can also be used to treat other coal-derived liquid streams such as filter cake or vacuum bottoms streams. For example, vacuum bottoms stream 118 could be treated in a gas-liquid contact step using a similar gas mixture to increase the magnetic susceptibility of the solids therein. To reduce the viscosity of the heavier liquid streams such as vacuum bottoms to achieve easier handling, a light diluent oil may be preferably added upstream of the gas treatment and magnetic separation steps.

While this invention has been described utilizing a preferred upflow catalytic ebullated bed type hydrogenation reactor, it is also considered applicable and useful for fixed bed type catalytic reactors as well as for upflow ebullated bed non-catalytic type reactors wherein the unreacted coal and ash particles alone serve as the contact solids materials in the reaction zone.

This invention is supported by runs which demonstrate that significant increases in the magnetic susceptibility of sulfur-containing coal solids can be obtained from coal-derived liquid by treatment with gas mixtures containing various concentrations of hydrogen sulfide and hydrogen. Such pretreatment step can be followed by a magnetic separation step for removal of magnetizable solid materials.

EXAMPLE

To illustrate this invention, runs are made using samples of Illinois No. 6 coal having sulfur analysis as given in Table 1. These coal samples are hydrogenated using the reactor conditions listed in Table 1, and the magnetic susceptibility of the resulting solids is determined. It is noted that the solids extracted from the flash pot bottoms stream is more magnetic than that from the vacuum still bottoms stream.

These two samples of coal liquid are then contacted at elevated temperature with a gas mixture comprising various concentrations of hydrogen sulfide and hydrogen. Because of the high viscosity of the vacuum still bottoms stream, it is diluted with an equal volume of Ashland APO aromatic solvent oil to facilitate handling. The runs are carried out in a one-liter capacity autoclave unit, with the gas mixture being bubbled up through the liquid and then vented. The magnetic susceptibility of the solids is then determined using a Guoy balance instrument having a 1.5-inch electromagnet (Newport Instruments Model Type C) and its associated power supply, and a weight balance by Stanton, Ltd.

TABLE 1

| Coal feed | Illinois No. 6 (Monterey Mine) | Illinois No. 6 (River King Mine) |
|---|---|---|
| Sulfur in Coal (Dry Basis), W % | | |
| Pyritic | 1.23 | 1.70 |
| Sulfate | 0.20 | 0.05 |
| Organic | 2.80 | 2.06 |
| **Operating Conditions** | **Run A** | **Run B** |
| Reactor Pressure, psig | 2900 | 2700 |
| Reactor Temperature, °F | 829 | 812 |
| Coal Feed Rate (Dry Basis), Lbs/Hr/Ft$^3$ Reactor Liquid Phase | 28.9 | 22.6 |
| Coal Liquid Stream | Flash Pot Bottoms | Vacuum Still Bottoms |
| Solids, W % | 17 | 30 |
| Magnetic Susceptibility of Solids | | |

TABLE 1-continued

| | | |
|---|---|---|
| Extracted, C.G.S. Units | $85 \times 10^{-6}$ | $60 \times 10^{-6}$ |

Results for the flash pot bottoms oil stream at 500°F temperature are shown in FIG. 3. It is seen that the magnetic susceptibility increases with gas-liquid contact time, and that no further increase occurs after about 5 minutes' contact time.

Results of liquid treatment tests made on vacuum still bottoms oil stream diluted with 50 wt. % Ashland APO aromatic solvent oil are shown in FIGS. 4 and 5. It is seen that a greater increase in the magnetic susceptibility of the solids occurs with residence time for the vacuum bottoms oil than for the flash pot bottoms oil. Also, FIG. 4 indicates that the hydrogen sulfide concentration in the treating gas mixture should be greater than about 2.5 vol. percent. Furthermore, FIG. 5 indicates that suitable gas treatment temperature is 400°–500°F and should not exceed about 650°F for desired results.

Following the gas treatment step, the coal liquid is passed to a magnetic separation unit having a field strength of 5000–20,000 gauss. The magnetic solids material along with some liquid is retained within the magnetized flow passages of the unit. The remaining liquid portion containing reduced amounts of iron sulfide solids is withdrawn from the separator and may be used for further processing. The magnetic solids-containing material is periodically removed from the demagnetized flow pasages by flushing with a light solvent oil.

While we have shown and described a preferred form of embodiment of our invention, we are aware that modifications may be made thereto within the scope and spirit of the disclosure and as defined by the appended claims.

We claim:

1. A process for magnetic separation of sulfur-containing solids from a hydrocarbon liquid derived from coal containing at least about 0.2 wt. percent pyritic sulfur which comprises:

a. contacting the hydrocarbon liquid with a treating gas mixture containing between about 2–15 volume percent, hydrogen sulfide and between 85–98 volume percent hydrogen and maintaining a residence time for the liquid-gas contact of at least 2 minutes at temperatures sufficiently above ambient whereby the iron sulfides are changed in chemical form, thereby increasing the magnetic susceptibility thereof;

b. passing the treated liquid through a passage way located within a magnetic field having strength of at least about 3000 gauss to temporarily retain the magnetic particles within the flow passage, thereby reducing the concentration of magnetically susceptible particles within the liquids;

c. withdrawing a liquid stream containing reduced solids concentration from the magnetic field;

d. demagnetizing the flow passage of the magnetic separator;

e. removing the retained sulfur-containing magnetic solid particles from the flow passages of the magnetic separator.

2. The process of claim 1 wherein the treating gas mixture contains between 5 and 15 volume percent hydrogen sulfide and 85–95 volume percent hydrogen.

3. The process of claim 1 wherein the liquid-gas contacting temperature is 350 to 600°F.

4. The process of claim 1, wherein the liquid gas contact is conducted at a contacting pressure of at least 50 psig.

5. The process of claim 1 wherein the liquid-gas residence time is between 5 and 15 minutes.

6. The process of claim 1 wherein the magnetic solids temporarily retained within the magnetizable flow passages are removed by flushing with a light hydrocarbon oil.

7. The process of claim 1 wherein the light oil used to flush the accumulated solids from the magnetizable flow passages is recovered and reused.

8. A process for magnetic separation of sulfur-containing solids from a hydrocarbon liquid derived from coal containing at least about 0.2 wt. percent pyritic sulfur which comprises:

a. contacting the hydrocarbon liquid with a treating gas mixture containing between about 5–15 volume percent, hydrogen sulfide and between about 85–98 volume percent, hydrogen, at temperatures between about 350°–600°F and maintaining a residence time for the liquid gas contact between about 5–15 minutes, and at a pressure of at least 50 psig, whereby the chemical form of the iron sulfides is changed, thereby increasing the magnetic susceptibility of the iron sulfides;

b. passing the treated liquid through a passageway located within a magnetic field having strength between about 5000–20,000 gauss to temporarily retain the magnetic particles within the flow passage, thereby reducing the concentration of magnetically susceptible particles within the liquids;

c. withdrawing a liquid stream containing reduced solids concentration from the magnetic field;

d. demagnetizing the flow passage of the magnetic separator;

e. removing the retained sulfur-containing magnetic solid particles from the flow passages of the magnetic separator.

9. In a process for hydrogenating coal, comprising the steps of (1) reacting particulate coal under liquid phase conditions in a reaction zone at temperatures in the range of 750°–950°F and superatmospheric pressure for a sufficient time to convert at least 50 wt. percent of the coal to liquid and gaseous products, said liquid products containing magnetically susceptible iron sulfides solids; (2) magnetically separating magnetically susceptible particles from the liquid product; and (3) recovering a liquid of reduced solids concentration; the improvement comprising, contacting the hydrocarbon liquid and solids with a treating gas mixture containing between about 2–15 volume percent, hydrogen sulfide and between about 85–98 volume percent hydrogen and maintaining a residence time for the liquid-gas contact of at least about 2 minutes at temperatures sufficiently above ambient, whereby the iron sulfides are changed in chemical form, thereby increasing the magnetic susceptibility of the iron sulfides, prior to the magnetic separation step.

10. The process of claim 9, wherein the contacting temperature is between 350°–600°F.

11. The process of claim 9, wherein the contact time between the treating gas and liquid containing iron sulfide solids is between 5 and 15 minutes.

12. The process of claim 9, wherein the treating gas mixture contains between 5 and 15 volume percent hydrogen sulfide and between 85–95 volume percent hydrogen.

13. The process of claim 9, wherein the contacting temperature is between 350°and 600°F, the contact time between the treating gas and liquid containing iron sulfides is between 5–15 minutes, and the treating gas mixture contains between 5–15 volume percent hydrogen sulfide and between 85–95 volume percent hydrogen.

14. A process for removing particulate solids containing iron sulfide impurities from coal-derived liquid which comprises:

a. treating the coal-derived liquid by contacting it with a gaseous mixture containing between about 2–15 volume percent hydrogen sulfide and betwen about 85–98 percent hydrogen for at least about 2 minutes at temperatures sufficiently above ambient to change the chemical form of the iron sulfide and increase the magnetic susceptibility thereof;

b. passing the treated coal derived through to a magnetic separator having magnetic field with strength of at least 3000 gauss to attract and retain the magnetically susceptible sulfur-containing particles on metal matrix surfaces within the passageway;

c. withdrawing a liquid stream containing reduced solids concentration from the magnetic separator;

d. passing the liquid stream containing a reduced concentration of magnetic particles to a solids separation step for recovery of non-magnetic solids from the product stream:

e. passing a light oil stream derived from the process through the magnetic separator passageway to remove the retained sulfur-containing particles from the matrix surfaces by flushing.

15. The process of claim 14, wherein the light oil stream used to flush the sulfur-containing solids from the magnetic separator matrix surfaces is recovered in a solvent separation step and is returned to the magnetic separator for reuse, and the sulfur-containing solids are removed from the solent separation step.

16. The process of claim 14, wherein the magnetic separator is operated at temperatures between 300° and 600°F.

17. The process of claim 14 further comprising the step of adjusting the viscosity of the coal derived liquid to between about 2 and 10 centipoise prior to passing the coal derived liquid to the magnetic separator.

18. The process of claim 14 wherein the magnetic separator is a rotary drum type unit and the metal matrix surfaces are demagnetized by removal from the magnetic field.

19. The process of claim 14, wherein the magnetic field strength is between 5,000 and 20,000 gauss.

20. The process of claim 14, wherein the liquid-gas contacting temperature is between about 350° and 600°F.

21. The process of claim 14, wherein the liquid-gas contact is conducted at a contacting pressure of at least 50 psig.

22. The process of claim 14, wherein the treating gas is in contact with the iron-sulfide containing liquid for between about 5 to 15 minutes.

23. The process of claim 14, wherein the liquid-gas contacting temperature is between 350°and 600°F and the liquid-gas contact time is between 5 to 15 minutes and the treating gas contains between 5 and 15 volume percent hydrogen sulfide and between 85–95 volume percent hydrogen.

24. A process reducing pyrite content of a coal derived liquid combining the steps of:

a. contacting the pyrite containing liquid with a gas consisting essentially of about 2–15 volume percent hydrogen sulfide and about 85–98 volume percent hydrogen for at least 2 minutes at temperatures sufficiently above ambient and below 650°F to substantially increase the magnetic susceptibility of pyrite material;

b. magnetically separating the pyrite material from the liqud and;

c. recovering liquid hydrocarbon of reduced pyrite concentration.

25. The process of claim 24, wherein the liquid-gas contact temperatures is between 350° and 600°F.

26. The process of claim 24, wherein the coal derived liquid is the liquid product of the liquid phase hydrogenation of coal.

27. The process of claim 24, wherein the liquid gas contact time is between about 5 and 15 minutes.

28. The process of claim 24, wherein the liquid gas contact temperatures is between 350° and 600°F, the liquid-gas contact time is between 5 and 15 minutes, and the contacting gas consists essentially of between 5 and 15 volume percent hydrogen sulfide and between 85–95 volume percent hydrogen.

* * * * *